US005538157A

United States Patent [19]

Proshan

[11] Patent Number: 5,538,157

[45] **Date of Patent: * Jul. 23, 1996**

[54] TEMPERATURE LIMITING CAP NO. 1 FOR DISPOSABLE CONTAINERS OF LIQUID

[76] Inventor: Mary-Elizabeth Proshan, Suite 194, 301 N. Harrison St., Princeton, N.J. 08540

[ * ] Notice: The term of this patent shall not extend beyond the expiration date of Pat. No. 5,538,156.

[21] Appl. No.: 396,017

[22] Filed: Feb. 28, 1995

[51] Int. Cl.[6] ..... B65D 5/72; B65D 5/74; B65D 25/40; B65D 41/18

[52] U.S. Cl. ..... 220/717; 220/306; 220/711; 220/713; 222/570

[58] Field of Search ..... 220/717, 711, 220/713, 718; 229/404; 222/569, 570, 567, 568

[56] References Cited

U.S. PATENT DOCUMENTS

| | | | |
|---|---|---|---|
| 1,045,319 | 11/1912 | Parker | 222/568 |
| 2,317,046 | 4/1943 | Fleming | 220/717 |
| 4,850,496 | 7/1989 | Rudell et al. | 220/713 X |
| 5,433,338 | 7/1995 | Proshan | 220/717 |

*Primary Examiner*—Allan N. Shoap
*Assistant Examiner*—Niki M. Kopsidas

[57] ABSTRACT

A flat horizontal disc has a pin hole therein and a peripheral socket. A vertical hollow spout extends above the disc and is integral therewith. The spout has rectangularly shaped open upper and lower ends and tapers downwardly and and outwardly toward the disc. The open lower end is coincident with an opening in the disc which communicates with the socket. A longitudinal portion of the spout is provided with a recess which extends downwardly from the top of the spout to a step disposed above the disc. The step has an upper horizontal surface and extends generally vertically downward to the disc. The spout has a horizontal opening in the peripheral interior of the spout. The opening is spaced vertically downward below the horizontal surface and extends between the horizontal surface and the peripheral interior.

9 Claims, 3 Drawing Sheets

TEMPERATURE LIMITING CAP NO. 1 FOR DISPOSABLE CONTAINERS OF LIQUID

REFERENCE TO COPENDING APPLICATION

The present application is related to copending TEMPERATURE LIMITING CAP NO. 2 FOR DISPOSABLE CONTAINERS OF LIQUID filed on even date herewith, Ser. No. 08/396016. Both applications identify the same inventor and are owned in common.

BACKGROUND OF THE INVENTION

Disposable containers containing cold or hot liquids are in wide use. In order to prevent the liquid from being accidently spilled during use, it is known to cover the open upper end of the container with a disposable cap having an upwardly extending spout. The user drinks from the spout. It is also known to cover the open upper end of the container with a cap having a small removable section. In this application, the user removes the section, leaving a small opening. The user tilts the container until the liquid is poured out of the opening into the user's mouth. In either application, the cap has a peripheral socket which sealably engages the periphery of the upper end of the container.

In order to prepare certain liquids such as coffee, it is often necessary to heat such liquids to temperatures which are extremely high. These hot liquids are often dispensed into disposable containers using caps which either have a spout or a removable section as described above. In either situation, an individual drinking such hot liquids from such containers can be badly burned.

The present invention is directed toward a new type of disposable cap provided with an upwardly extending drinking spout so constructed that the temperature of the liquid is automatically reduced to a more tolerable level during the process in which the liquid is drawn from the cup through the spout in to the mouth of the individual drinking the liquid and the risk of burning is reduced.

SUMMARY OF THE INVENTION

Accordingly, it is an object of the present invention to provide a new and improved disposable cap provided with an upwardly extending spout for disposable containers filled with hot liquids wherein the temperature of the liquid is automatically reduced to a more tolerable level during the process in which the liquid is drawn from the cup through the spout into the mouth of the individual drinking the liquid and the risk of burning is reduced.

Another object is to provide a new and improved disposable cap of the character indicated which can be manufactured easily and inexpensively.

These and other objects and advantages of the invention will either be explained or will become apparent hereinafter.

In accordance with the principles of this invention, a cap for detachably enclosing an upper open end of a hollow vertical disposable container with liquid therein takes the form of a flat horizontal disc having a pin hole therein. The disc has a peripheral socket adapted to engage the periphery of the upper end of the container in such manner that liquid cannot flow out therebetween.

A vertical hollow spout spaced from the pin hole is employed for delivery of the liquid. The spout tapers outwardly and downwardly from an open rectangularly shaped upper end to a lower rectangular opening coincident with a like opening in the disc which communicates with the socket. A portion of the spout is provided with a recess which extends downwardly from the top of the spout to a step disposed above the disc. The step has an upper horizontal surface and extends generally vertically downward to the disc.

When the container is filled with hot liquid such as coffee and the cap is connected to the container, a user will tilt the container and place the spout in the user's mouth, with the user's top lip engaging the portion of the spout with the opening and the user's lower lip engaging an opposite portion of the spout.

As the user drinks, the temperature of the liquid is automatically reduced to a more tolerable level during the process in which the liquid is drawn from the cup through the spout into the mouth of the user and the risk of burning is reduced.

DETAILED DESCRIPTION OF PREFERRED EMBODIMENT

Figure 1:
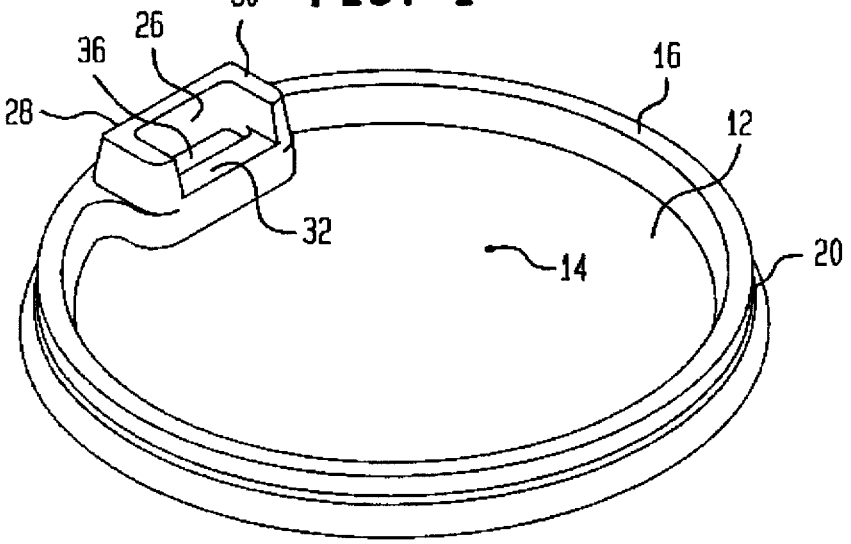
FIG. 1 is a top perspective view of a preferred embodiment of the invention.
Figure 2:
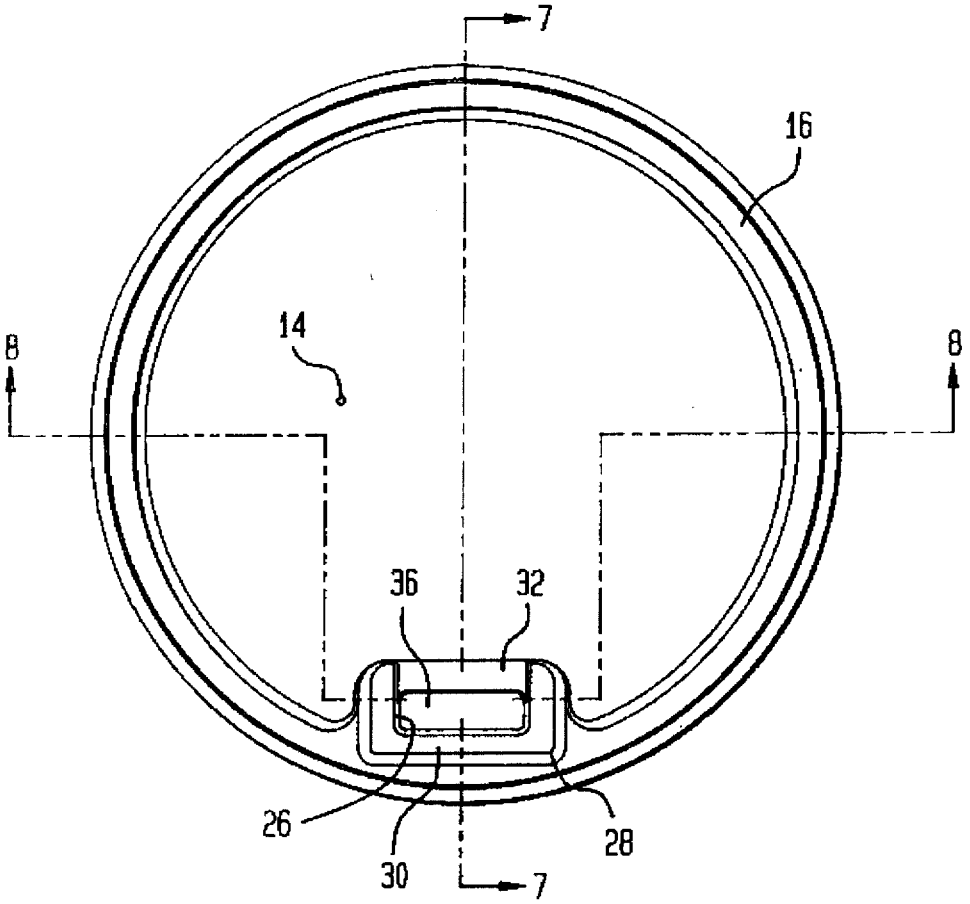
FIG. 2 is a top plan view thereof.
Figure 3:
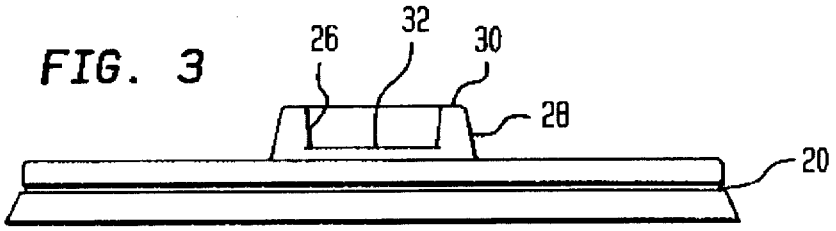
FIGS. 3 and 4 are opposite end views thereof.
Figure 4:
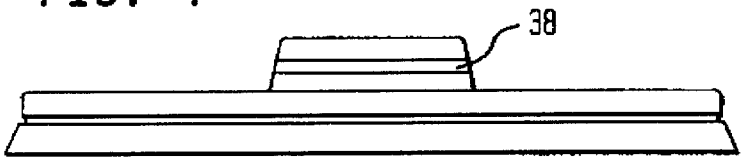
Figure 5:
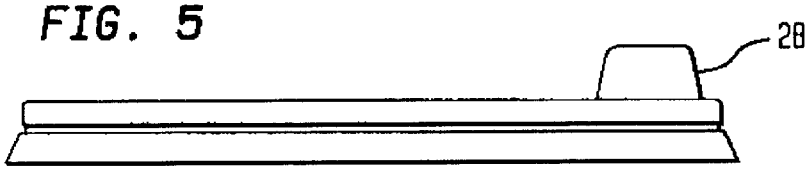
FIG. 5 is a side view thereof.
Figure 6:
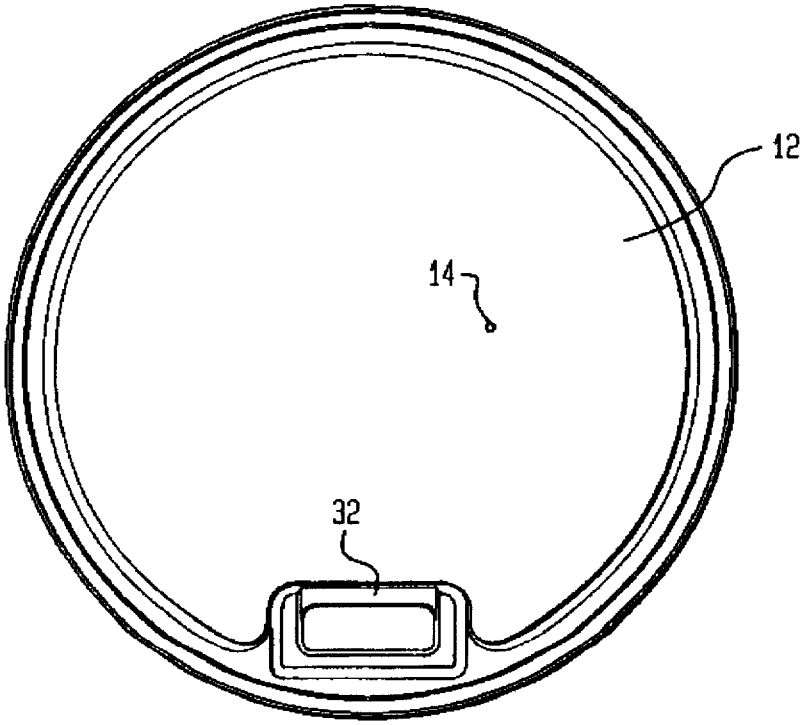
FIG. 6 is a bottom view thereof
Figure 7:
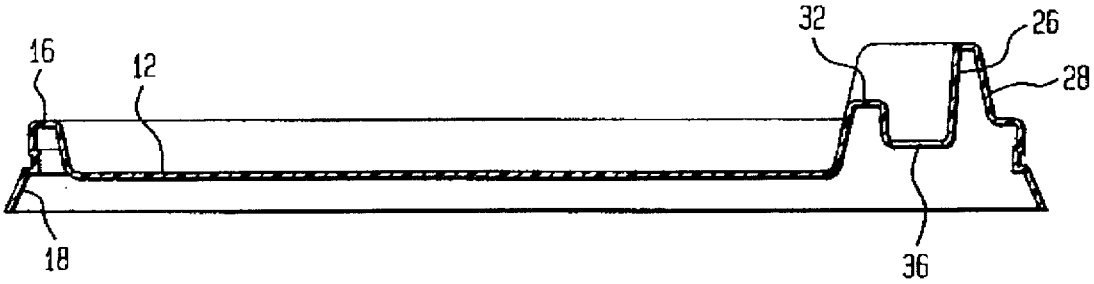
FIG. 7 is a detail view of the spout in vertical cross section as taken at right angles to the width of the spout.
Figure 8:
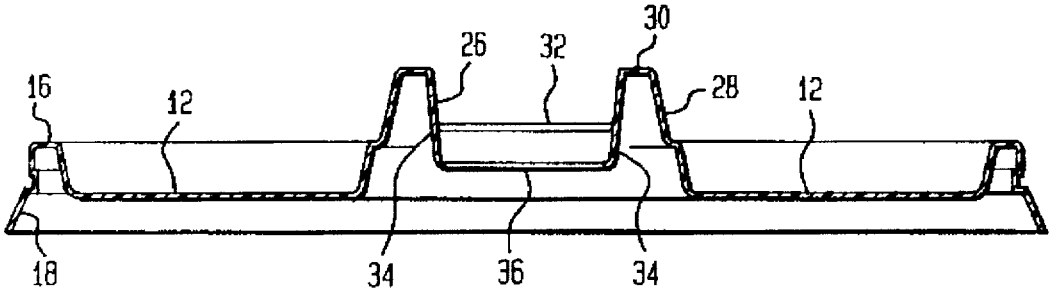
FIG. 8 is a detail view of the spout in vertical cross section as taken at right angles to the cross sectional view shown in FIG. 7.

Referring now to FIGS. 1–8, there is shown a cap for detachably enclosing an upper open end of a hollow vertical disposable container with liquid therein. The container has a closed lower end.

The cap employs a flat horizontal disc 12 having an opening 14 which is a pin hole and is used to establish a path for air to escape when the cap is positioned on a container filled with liquid as well as enabling air to enter the container as the liquid is consumed and its level is reduced.

A vertical hollow spout for delivery of the liquid tapers upwardly and outwardly from the disc. The spout has open upper and lower ends which are rectangularly shaped. The openings in each end are rectangularly shaped, the lower opening being larger than the upper opening, and both openings being much larger than pin hole 14. The opening in the lower end of the spout is coincident with a like opening in the disc which communicates with a socket 20 peripherally secured to the disc.

The spout has an outer rectangularly shaped wall 28 which is centered on and outwardly spaced from inner wall 26. These two walls are connected at the top opening by a flat horizontal member 30. The elongated rectangular portions of both walls which are remote from the periphery of the disc are cut away to form a generally rectangular cut out region or recess which extends downwardly from the top opening to a step having a flat horizontally elongated member 32 which is integral with both walls.

The outer wall of the step is coincident with a portion of wall 28 and extends downwardly from member 32 to the opening in the lower end of the spout. The inner wall of the step is coincident with a portion of wall 26 and also extends downwardly from member 32 to a horizontal rectangular opening 36.

Opposite vertical side walls 34 of the step extend upwardly to member 30 and downwardly from member 32 to opening 36. These walls 34 are integral with member 32 and are also integral with the inner wall 26. Consequently, the horizontal rectangularly shaped opening 36 extends between the periphery of the inner wall and the member 32. Opening 36 is disposed below member 32 and is connected thereto by wall 26. Opening 36 is smaller than the lower end opening of the spout and as shown is disposed about half way between the upper and lower ends of the spout although opening 36 can also be disposed further downward toward the lower end of the spout. Opening 36 is the opening through which liquid is drawn by a user when drinking.

The disc has a socket 20 which is adapted to engage the periphery of the upper end of the container so tightly that liquid cannot flow out therebetween. This socket can have an annular recess which extends above the disc as shown at 16 and also extends below the disc as shown at 18. Alternatively, the socket can be peripherally disposed about the disc and the annular recess can be eliminated. Some types of containers require the use of a socket with a recess while other types require use of a socket without a recess.

When a socket with an annular recess is used, the opening in the disc is disposed partially on the socket and partially on the disc. When a socket without an annular recess is used, this opening is disposed entirely in the disc and is located adjacent the socket.

As previously explained, when a container is filled with hot liquid such as coffee and the cap is connected to the container, a user will tilt the container so that the spout placed in the user's mouth, with the user's top lip engaging the portion of the spout with the opening and the user's lower lip engaging an opposite portion of the spout.

As the user drinks, the temperature of the liquid is automatically reduced to a more tolerable level during the process in which the liquid is drawn from the cup through the spout into the mouth of the user and the risk of burning is reduced. This reduction ensues both because of the contact of the hot liquid both with the ambient air and the air inhaled by the user during the process of drinking.

The outer wall of the spout can have a plurality of vertically spaced horizontal shallow recesses 38 as can the outer wall of the opposite portion of the spout. When the recesses 38 are present, portions of the upper and lower lips of the user are spaced from the spout, thus providing air channels which further promote the cooling action.

Illustrative dimensions for the spout shown in the preferred embodiment are as follows. The spout extends about 0.30 inches above the disc; the step member 32 extends about 0.10 inches above the disc and is about 0.10 inches wide; the rectangle defined by the outer wall is about 0.90 inches by about 0.50 inches; and the horizontal separation of the inner and outer walls at the top of the spout is about 0.10 inches. Opening 36 is a rectangle about 0.63 inches long and about 0.12 inches wide. The angle of taper of the spout is about 5 degrees.

While the invention has been described with particular reference to the preferred embodiment and the drawings, the protection sought is to be limited only by the terms of the claims which follow.

What is claimed is:

1. A cap for detachably enclosing an upper open end of a hollow vertical disposable container with hot liquid therein, said cap comprising:

a flat horizontal disc having a pin hole therein and a peripheral socket adapted to engage the periphery of the upper end of the container in such manner that liquid cannot flow out therebetween;

a vertical hollow spout for delivery of said liquid which extends above the disc and is integral therewith, said spout having rectangularly shaped open upper and lower ends and tapering downwardly and outwardly toward the disc, the open lower end being coincident with an opening in the disc which communicates with the socket;

the spout as viewed in a horizontal plane having two opposite longitudinal sides, one side incorporating a recess which extends downwardly from the top of the spout to a step disposed above the disc, the step having an upper horizontal surface and extending generally vertically downward to the disc, the spout having a horizontal opening in the peripheral interior of the spout, the opening being spaced vertically downward below the horizontal surface and extending between the horizontal surface and the peripheral interior.

2. The cap of claim 1 wherein one longitudinal side of the spout is disposed remotely from the socket and the other longitudinal side is disposed adjacent the socket, the remotely disposed side having said recess.

3. The cap of claim 1 wherein the spout has concentric outer and inner walls joined at the top by an integral flat horizontal connector, the step having an outer wall integral with the outer wall of the spout and having a vertical section disposed between its top horizontal surface and said member which is integral with the inner wall of the spout.

4. A cap for detachably enclosing an upper open of a hollow vertical disposable container with hot liquid therein, said cap comprising:

a flat horizontal disc having a pin hole therein and a peripheral socket adapted to engage the periphery of the upper end of the container in such manner that liquid cannot flow out therebetween;

a vertical hollow spout for delivery of said liquid which extends above the disc and is integral therewith, said spout having rectangularly shaped open upper and lower ends and tapering downwardly and and outwardly toward the disc, the open lower end being coincident with an opening in the disc which communicates with the socket;

the spout having outer and inner walls which are spaced apart and are joined at the upper end of the spout by a flat horizontal member;

the spout as viewed in a horizontal plane having two opposite longitudinalsides one of which is provided with a recess which extends downwardly from the top of the spout to a step disposed above the disc, the step having an upper horizontal surface and having an outer wall which is integral with the corresponding outer wall of the spout and extends generally vertically downward to the disc;

the spout having a horizontal opening for liquid to flow through which is spaced vertically below the horizontal surface and extends between the horizontal surface and the peripheral interior of the spout.

5. The cap of claim 4 wherein the step has an inner wall which extends downwardly from the horizontal surface to one side of said opening.

6. The cap of claim 5 wherein the step and opening have opposite vertical end walls which are integral with the inner wall of the spout and the horizontal member.

7. The cap of claim 6 wherein the opposite side of said opening is integral with a another vertical wall, said another wall being integral with the said end walls and said horizontal member.

8. The cap of claim 7 wherein the spout is disposed on the disc with the recess disposed outwardly from the socket and the portion of the spout oppositely disposed from the recess is disposed between the recess and the socket.

9. The cap of claim 8 wherein the outer surface of at least one longitudinal side of the outer wall is provided with a plurality of vertically spaced horizontally elongated recesses.

* * * * *